US011530110B2

(12) United States Patent
Dellach

(10) Patent No.: US 11,530,110 B2
(45) Date of Patent: Dec. 20, 2022

(54) CORD WINDER DEVICE

(71) Applicant: TECH RIM STANDARDS, LLC, Rochester Hills, MI (US)

(72) Inventor: Kenneth Dellach, Shelby Township, MI (US)

(73) Assignee: Tech Rim Standards, LLC, Rochester Hills, MI (US)

( * ) Notice: Subject to any disclaimer, the term of this patent is extended or adjusted under 35 U.S.C. 154(b) by 203 days.

(21) Appl. No.: 17/067,041

(22) Filed: Oct. 9, 2020

(65) Prior Publication Data

US 2022/0112048 A1 Apr. 14, 2022

(51) Int. Cl.
*B65H 51/06* (2006.01)
*B65H 75/44* (2006.01)

(52) U.S. Cl.
CPC ..... *B65H 75/4492* (2013.01); *B65H 51/06* (2013.01); *B65H 2404/185* (2013.01)

(58) Field of Classification Search
CPC ..... B65H 75/4423; B65H 75/4492; B65H 51/06; B65H 2404/185
See application file for complete search history.

(56) References Cited

U.S. PATENT DOCUMENTS

2014/0262616 A1* 9/2014 Cullum ..... E06C 7/188 242/384.7
2017/0213431 A1* 7/2017 Huo ..... B65H 75/4492

OTHER PUBLICATIONS http://green-leaf.us/wp-content/uploads/2017/05/WonderWinder_Duel-Instructions-2017.pdf pp. 1-2, publication date May 2017.*

* cited by examiner

*Primary Examiner* — Sang K Kim
(74) *Attorney, Agent, or Firm* — Brooks Group, PLC

(57) ABSTRACT

A number of illustrative variations may include a cord winder device that may include a housing that may include a first segment and a second segment. The product may further include a roller assembly positioned between the first segment and the second segment. The cord winder device may further include a lever assembly positioned between the first segment and the second segment. The cord winder device may further include a handle assembly in mechanical communication with the roller assembly. The cord winder device may be constructed and arranged to feed out or retract in cord, hose, cable, or the like.

19 Claims, 3 Drawing Sheets

CORD WINDER DEVICE

TECHNICAL FIELD

The field to which the disclosure generally relates to includes cord winders.

BACKGROUND

Cord winders may include the means for automatically or manually retracting a cord, hose, rope, string, or the like.

SUMMARY OF ILLUSTRATIVE VARIATIONS

A number of variations may include a housing may include a first segment and a second segment and defining a first opening and a second opening; a roller assembly; a lever assembly; and a handle assembly.

A number of variations may include a product that may include a housing that may include a first segment and a second segment the housing defining a first opening and a second opening; wherein the first segment defines a first through hole, first guide channel, a first lever slot, and a first lever lock notch, and wherein the second segment defines a second through hole, a second guide channel, a second lever slot, and a second lever lock notch. The product may further include a roller assembly positioned between the first segment and the second segment and in mechanical communication with the first through hole and the second through hole. The product may further include a lever assembly positioned between the first segment and the second segment and in mechanical communication with the first and second guide channels, the first and second lever slots, and the first and second lever lock notches. The product may further include a handle assembly in mechanical communication with the roller assembly.

A number of variations may include a product may include a housing that may include a first segment and a second segment, the housing defining a first opening and a second opening; wherein the first segment defines a first through hole, first guide channel, a first lever slot, and a first lever lock notch, and wherein the second segment defines a second through hole, a second guide channel, a second lever slot, and a second lever lock notch. The product may further include a roller assembly that may include a first roller may include an elastic roller surface, the roller assembly being positioned between the first segment and the second segment and in mechanical communication with the first through hole and the second through hole. The product may further include a lever assembly positioned between the first segment and the second segment and in mechanical communication with the first and second guide channels, the first and second lever slots, and the first and second lever lock notches, the lever assembly being constructed and arranged to bias a cord towards the first roller. The product may further include a handle assembly in mechanical communication with the roller assembly constructed and arranged to allow a user to rotate at least the first roller.

Other illustrative variations within the scope of the invention will become apparent from the detailed description provided hereinafter. The detailed description and specific examples, while disclosing variations of the invention, are intended for purposes of illustration only and are not intended to limit the scope of the invention.

BRIEF DESCRIPTION OF THE DRAWINGS

Select examples of variations within the scope of the invention will become more fully understood from the detailed description and the accompanying drawings, wherein.

DETAILED DESCRIPTION OF ILLUSTRATIVE VARIATIONS

Figure 1:
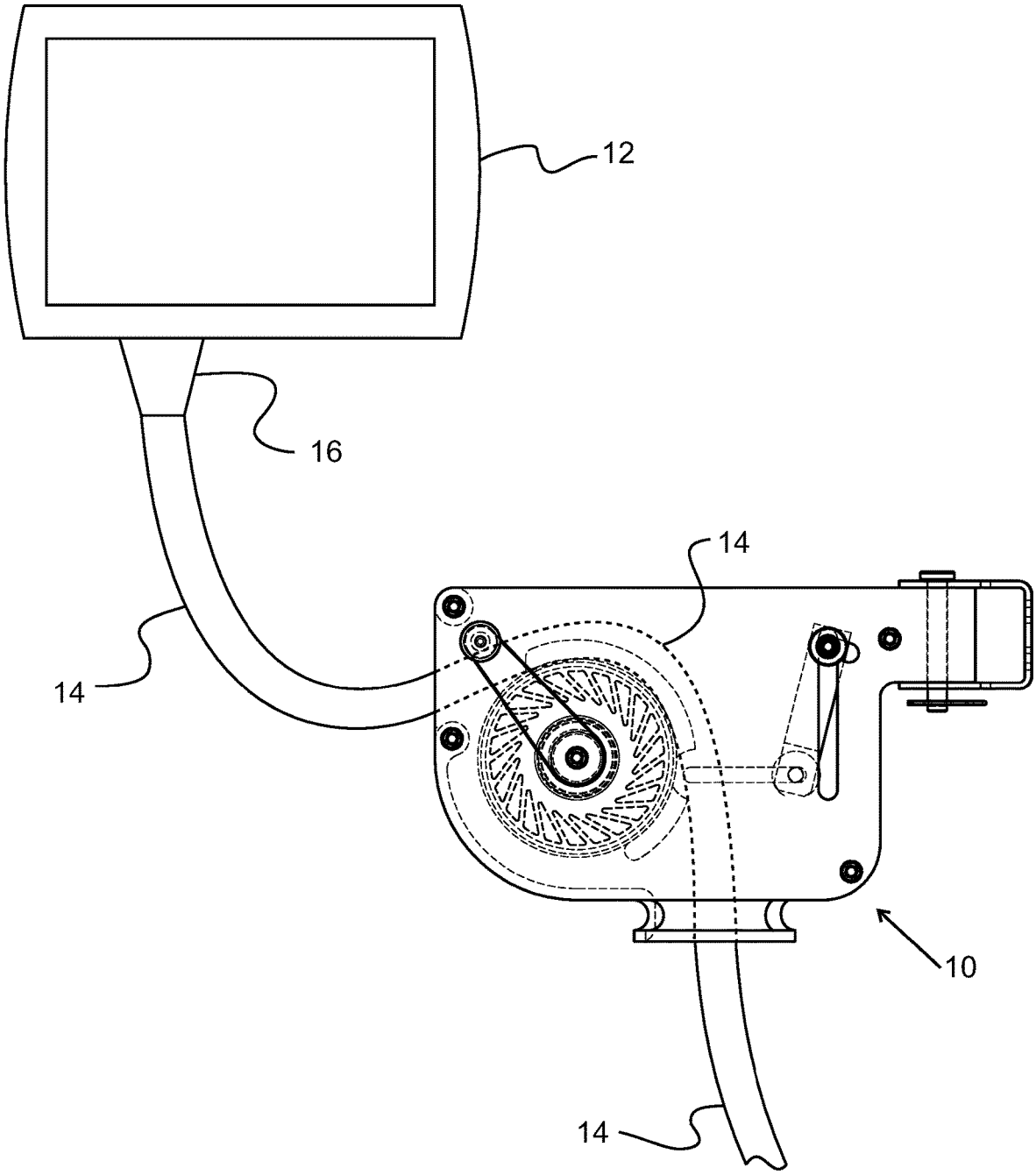
FIG. 1 depicts an illustrative variation of a cord winder device integrated with a teach pendant.

The following description of the variations is merely illustrative in nature and is in no way intended to limit the scope of the invention, its application, or uses.

As used herein, "operating environment" may refer broadly to industrial settings, commercial settings, residential settings, factories, laboratories, or the like. The operating environment may include conditions such as high vibration, high ambient volume and temperature, high dust, dirt, or moisture environments, and may include direct or indirect exposure to heat, moisture, sparks, etc.

As used herein, "teach pendant" or "pendant" may refer broadly to any HMI or user operated, commonly handheld, device for controlling an industrial robot or machine remotely. Pendants may be used to control, operate, repair, or troubleshoot the machinery they are in electronic communication with. Pendants may include a cord and a connector providing for electronic communication with machinery including a robot or multiple robots. The connector may allow the pendant to interface with the cord such that they are mechanically and electrically communicating. Cords and connectors may be a variety of shapes, sizes, and materials. The cord, connector, and pendant may be exposed to adverse environmental conditions within the operating environment.

A cord winder has been developed which in a number of variation may be used in industrial settings, such as in conjunction with an electronic teach pendant or robot human machine interface (HMI), and may increase robust build quality, fire retardance, and ease of use including simple and quick insertion of a cord through the cord winder.

In a number of variations, cord winders used with pendants may allow a user to retract the cord of a pendant automatically or manually via a handle assembly connected to the cord winder device. The device may include a basket or net into which the cord may be coiled to further protect the cord from the operating environment. In a number variations, the device may be constructed and arranged to withstand exposure to adverse environmental conditions within the operating environment. In a number variations, the device may be constructed and arranged to function with pendants, cords, and connectors with a variety of shapes, sizes, materials, and configurations. In a number variations, the device may be constructed and arranged to allow installation of pendants, cords, and connectors in a variety of ways based upon the shapes, sizes, materials, and configurations of the pendant, cord, and connector. As a non-limiting example, the cord winder may define a first opening through which the cord may pass when being retracted or extended during use. During installation, maintenance, or other activity, it may be desirable to detach the pendant from the connector and cord and remove the cord and connector from the cord winder. As will become apparent from this description, the cord winder may provide for multiple means of installing or removing a cord and/or connector from the cord winder to accommodate pendants, cords, and connectors of various sizes, shapes, materials, and configurations.

In a number of variations, a cord winder assembly may include a cord winder and a net. The cord winder may include a housing, a roller assembly, a lever assembly, and a handle assembly. The roller assembly may include a first roller and may be positioned within the housing of the cord winder and may be in mechanical communication with the handle assembly, which may be positioned primarily on the exterior of the cord winder. The handle assembly may be constructed and arranged to rotate some or all of the roller assembly when a user rotates or turns the handle assembly. The lever assembly may be primarily positioned within the housing of the cord winder. The lever assembly may include a lever, a second roller, and at least one lever knob constructed and arranged to allow a user to engage or disengage the second roller from the cord. When engaged, the lever assembly may be constructed and arranged to bias the cord towards the first roller such that when the handle assembly is rotated, the second roller holds the cord towards the first roller as the cord is fed from or retracted into the net. The housing of the cord winder may define a first opening and a second opening, through which a cord may be threaded or may pass through. The cord may be threaded through the second opening nearest the net, over a portion of the roller assembly, and through the first opening, or vice versa. The roller assembly may be constructed and arranged to feed the cord from or retract the cord into the net when a user rotates or turns the handle assembly. The roller may engage the cord primarily by means of friction, however, other means of the roller engaging the cord are contemplated and are not considered a departure from this disclosure.

In a number of variations, the housing of the cord winder may include a sandwich design whereby the housing may include a first segment opposite a second segment such that the housing of the cord winder may be separated to provide access to at least the roller assembly, lever assembly, and any additional internal components of the cord winder. The first segment and second segment may be metal, constructed and arranged to withstand a hostile or adverse operating environment. First and second segments may be entirely separable.

In a number of variations, the housing of the cord winder may define a first opening and a second opening, through which a cord may be threaded or may pass through. It is contemplated that in use the cord may be threaded through the second opening nearest the net, over a portion of the roller assembly, and through the first opening, or vice versa. It is also contemplated that, as is the case where the cord may have non-uniform thickness or may include a connector too large too thread through the housing, the first opening, or the second opening of the cord winder, the first segment may be temporarily separated from the second segment such that the cord and connector may be fed through the cord winder without having to modify or manipulate the size of the connector. The first segment and the second segment may then be combined to secure the cord therein. It is also contemplated that the sandwich design of the cord winder provides for increased ease of accessibility, repair, and replacement of internal components of the cord winder as well as increased ease of accessibility, repair, and replacement of a cord, connector, and/or pendant.

In a number of variations, the housing that may include a sandwich construction may provide the advantage of providing a number of methods by which a cord may be threaded through or inserted into the housing. A first method may include threading a relatively small diameter cord with an accompanying small connector through the second opening, over a portion of the roller assembly, and through the first opening after which the cord and connector may be attached to a pendant or similar device. A second method may include installing a relatively large diameter cord with an accompanying relatively large connector by first separating the first segment of the housing from the second segment of the housing, installing the large cord and connector, and reassembling the first and second segments. In a number of variations, the described methods may provide the advantage of a means for installing a cord without powering down a larger system or first disconnecting a cord such as an HMI cable before installing within a cord winder device.

The first segment and second segment may define a first through hole and a second through hole, respectively, constructed and arranged to mechanically engage the roller assembly. The first segment and second segment may define a first guide channel and second guide channel, respectively, as well as a first lever slot and second lever slot, respectively, constructed and arranged to mechanically engage at least a portion of the lever assembly and to allow a user to engage the second roller with a cord or to lock the second roller away from engaging the cord via at least one lever lock notch defined by the first segment, second segment, or both. A plurality of mechanical connections such as screws, bolts, or the like may facilitate sandwiching the first segment and the second segment together.

The roller assembly may include a first roller that may include a roller surface constructed and arranged to mechanically engage a cord primarily by means of friction, in addition to other means. The first roller include a metal hub, such as steel, and further may have a roller surface that may include a somewhat soft material, such as but not limited to, neoprene, rubber, gel, or other elastic or soft material constructed and arranged to provide increased friction between a cord and the first roller by increasing the surface area of contact between the first roller and a cord. The roller assembly may include at least one hub, bearing, bushing, bearing clip, bushing clip, and/or various other components constructed and arranged to facilitate rolling motion of the first roller. The components of the roller assembly may be press-fit together or fitted or assembled together by appropriate means.

In a number of variations, the roller assembly may provide the advantage of increased surface area of contact between the first roller and a cord when the second roller is applying slight pressure on the cord without the need for a compression spring sub-assembly to maintain firm pressure on the cord. In a number of variations, the roller assembly, in combination with at least one cord bumper described hereinafter may provide the advantage of increased control over the position of the cord within the cord winder device. Control of the position of the cord may be maintained via the at least one cord bumper and roller assembly as well as reducing the likelihood of the cord becoming pinched or stuck within the cord winder device by reducing travel of the cord across the width of the roller assembly and into any clearance between the roller assembly and the first segment or second segment of the housing.

The lever assembly may include a lever in mechanical communication with a second roller and a roller shaft. The lever assembly may further include at least one lever knob that may include a first lever knob and a second lever knob. The lever assembly may be constructed and arranged to allow a user to engage the second roller with a cord by moving the at least one lever knob up or down, thereby moving the second roller closer to or away from the first roller via the lever. The toiler shaft may be slidably seated in the first and second guide channels. The first and second lever knobs may be slidably seated in the first and second lever channels. In this way, the second roller may apply force on the cord towards the first roller to increase the surface area of contact between the first roller and the cord. The lever assembly may also be constructed and arranged to lock the second roller in a position away from engaging the cord via at least one lever lock notch defined by the first segment, second segment, or both.

A net may be positioned generally beneath the cord winder device and may be affixed to the cord winder device via a removable and/or reusable cable tie, zip-tie, or any other appropriate means for connecting the two. The net may be a rigid, metal cage or basket. The net may define a third opening constructed and arranged to correspond to the second opening of the cord winder device such that when the net may be connected to the cord winder device to share an opening through which a cord may be fed. The net may be constructed and arranged to facilitate the coiling of a cord therein. A fourth opening may be defined by the net and may be constructed and arranged to allow a cord to extend out of the net.

Referring to FIG. 1, an illustrative variation of a cord winder assembly may include a cord winder device 10 having a cord 14 passing through the cord winder device 10, wherein the cord winder device 10 is constructed and arranged to feed out or retract a cord 14. A pendant 12 may be in communication with the cord 14 via the connector 16, wherein the cord winder device 10 assembly may be constructed and arranged to allow installation of pendants, cords, and connectors in a variety of ways based upon the shapes, sizes, materials, and configurations of the pendant, cord, and connector.

Figure 2:
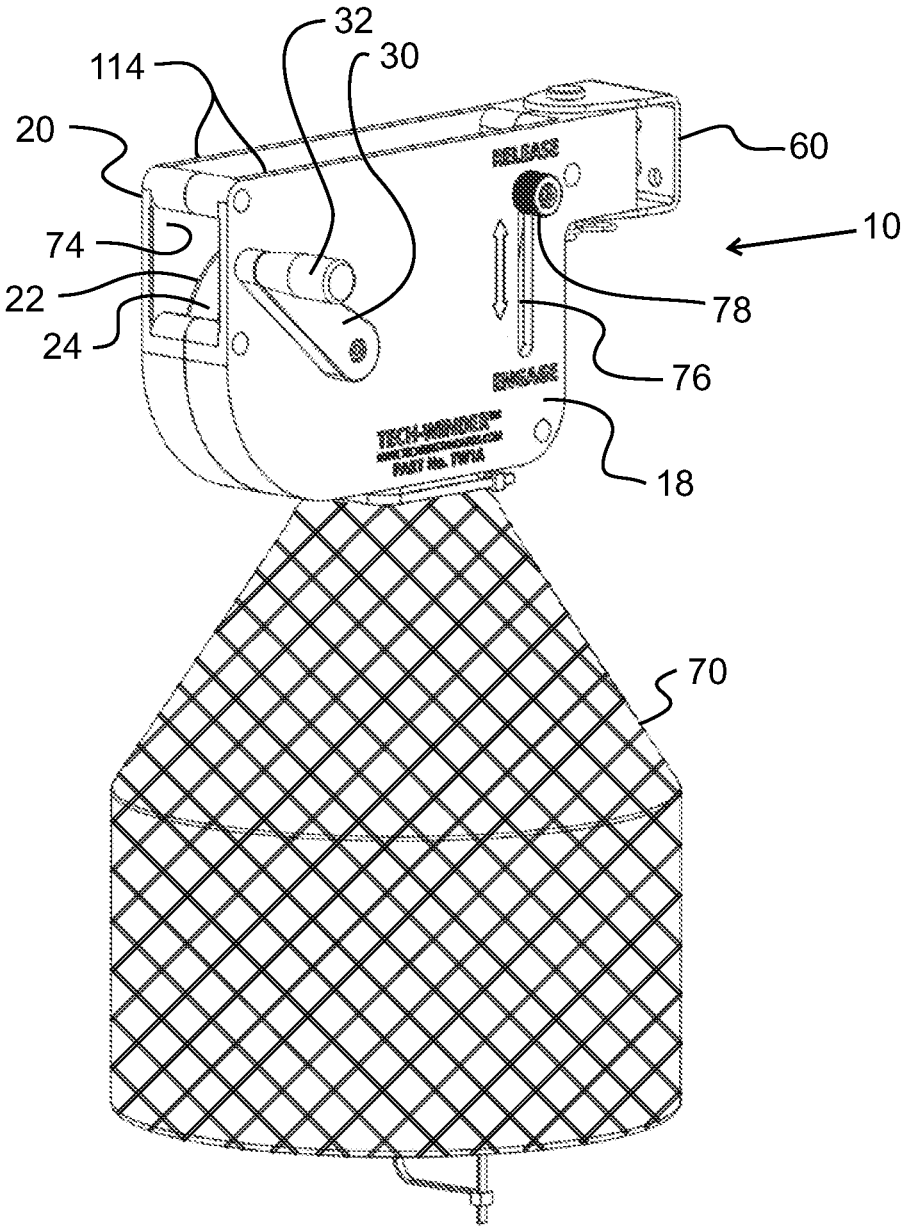
FIG. 2 depicts an illustrative variation of a cord winder device.

Referring to FIG. 2, an illustrative variation of a cord winder assembly may include a cord winder device 10 and a net 70. The cord winder device 10 may include a housing 114 including a first segment or cover portion 18 and a second segment or cover portion 20, the first segment or cover portion 18 and second segment or cover portion 20 being constructed and arranged to mechanically mate such that additional components of the cord winder device 10 may be assembled therein and to define a first opening 74. The cord winder device 10 may further include a roller 22 including a roller surface 24; a handle arm 30 including a tapered handle 32; a lever assembly 76 including at least one lever knob 78, the lever assembly 76 being constructed and arranged to allow a user to engage the cord for retraction. The cord winder device 10 may further include a hinge bracket 60 constructed and arranged to facilitate attachment of the cord winder assembly to a surface such as a floor, wall, or fence or the like.

Figure 3:
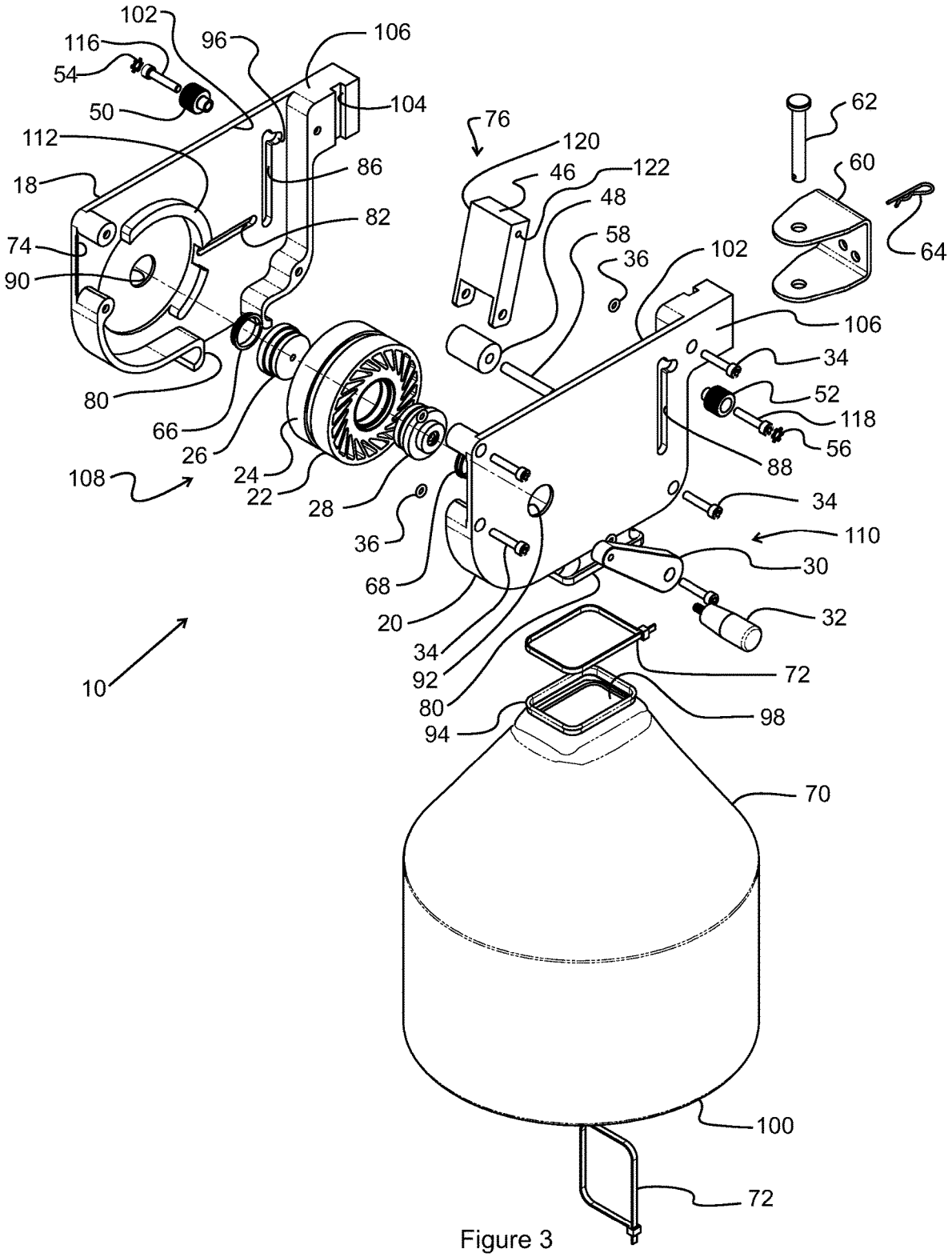
FIG. 3 depicts an exploded view of an illustrative variation of a cord winder device.

Referring to FIG. 3, an illustrative variation of an exploded view of a cord winder device 10 may include a sandwich design whereby the housing 114 may include a first segment 18 opposite a second segment 20. The first segment 18 or the second segment 20 or both may include at least one cord bumper 112. The first segment 18 and the second segment 20, in combination, may define a first opening 74, a second opening 80, and an open top 102. A cord may be threaded or fed through the first opening 74 and the second opening 20. The cord bumper 112 may be constructed and arranged to maintain the position of the cord during use and reduce traversal of the cord across the width of the roller during use. The first segment 18 and second segment 20 may define a first guide channel 82 and second guide channel (not shown), respectively, as well as a first lever slot 86 and second lever slot 88, respectively, constructed and arranged to mechanically engage at least a portion of the lever assembly and to allow a user to engage the second roller 48 with a cord or to lock the second roller away from engaging the cord via at least one lever lock notch 96 defined by the first segment 18, second segment 20, or both. A plurality of mechanical connections 34 such as screws, bolts, or the like and at least one o-ring 36 may facilitate sandwiching the first segment 18 and the second segment 20 together. The cord winder device 10 may further include a neck 106 defining a pin slot 104, the neck 106 being constructed and arranged to mechanically engage a hinge bracket 60, hinge pin 62, and cotter pin 64 such that the cord winder device 10 may be pivotably attached to a wall or structure.

The roller assembly 108 may include a first roller 22 that may include a roller surface 24 constructed and arranged to mechanically engage a cord primarily by means of friction, in addition to other means. The roller assembly 108 may also include a first hub 26, a second hub 28, a first clip bearing 66, a second clip bearing 68, and other various other components constructed and arranged to facilitate rolling motion of the first roller. The roller assembly 108 may be positioned to seat within the first through hole 90 and the second through hole 92 defined by the first segment 18 and second segment 20, respectively.

The handle assembly 110 may include a tapered handle 32 and a handle arm 30 in mechanical communication with the roller assembly 108, the tapered handle 32 being positioned at least some distance away from the roller assembly 108 such that the handle assembly 110 functions to allow a user to rotate at least a portion of the roller assembly 108 via the tapered handle 32 and handle assembly 110.

The lever assembly 76 may include a lever 46, a second roller 48, and a roller shaft 58 in mechanical communication with one another. The lever assembly 76 may further include at least one lever knob that may include a first lever knob 50 and a second lever knob 52. The first lever knob 50 may include at a first retaining ring 54 and a first lever pin 116. The second lever knob 52 may include a second retaining ring 56 and a second lever pin 118. The first lever pin 116 may extend through the first lever knob 50 and connect to the lever 46 at a first lever hole 120 defined by the lever 46 such that a user may user the first lever knob 50 to use the lever assembly 76. The second lever pin 118 may extend through the second lever knob 52 and connect to the lever 46 at a second lever hole defined by the lever 46 such that a user may user the second lever knob 52 to use the lever assembly 76. The lever assembly 76 may be constructed and arranged to allow a user to engage the second roller 48 with a cord by moving the first lever knob or second lever knob or both up or down causing roller shaft 58 to ride in the guide channel closer to or away from the first roller, thereby moving the second roller 48 closer to or away from the first roller 22 via the lever 46. The lever assembly 76 may also be constructed and arranged to lock the second roller 48 in a position away from engaging the cord via at least one lever lock notch 96 defined by the first segment, second segment, or both, wherein at least a portion of the first lever knob 50 or second lever knob 52 may sit in the lever lock notch 96 and may slidably travel within the first lever slot 86, second lever slot 88, or both.

A net 70 having a net neck 94 may be positioned generally beneath the cord winder device 10 and may be affixed to the cord winder device 10 via at least one zip-tie 72 or any other appropriate means for connecting the two. The net 70 may define a third opening 98 in the net neck 94 constructed and arranged to correspond to the second opening 80 of the cord winder device 10 such that when the net 70 may be connected to the cord winder device 10 to share an opening through which a cord may be fed. A fourth opening 100 may be defined by the net 70 and may be constructed and arranged to allow a cord to extend out of the net 70.

The following description of variants is only illustrative of components, elements, acts, product and methods considered to be within the scope of the invention and are not in any way intended to limit such scope by what is specifically disclosed or not expressly set forth. The components, elements, acts, products, and methods as described herein may be combined and rearranged other than as expressly described herein and still are within the scope of the invention.

According to variation 1, a housing may include a first segment and a second segment and defining a first opening and a second opening; a roller assembly; a lever assembly; and a handle assembly.

Variation 2 may include the product as set forth in variation 1 wherein the first segment and second segment may be detachably combinable to complete the housing.

Variation 3 may include the product as set forth in any of variations 1 through 2 wherein the first segment may define a first guide channel, a first lever slot, and a first lever lock notch.

Variation 4 may include the product as set forth in any of variations 1 through 3 wherein the second segment defines a second guide channel, a second lever slot, and a second lever lock notch.

Variation 5 may include the product as set forth in any of variations 1 through 4 wherein the roller assembly may include a first roller, at least one hub, and at least one clip bearing.

Variation 6 may include the product as set forth in any of variations 1 through 5 wherein the roller assembly may be a press-fit assembly that may include a first roller, a first hub, a second hub, a first clip bearing, and a second clip bearing.

Variation 7 may include the product as set forth in any of variations 1 through 6 wherein the first roller may include an elastic roller surface.

Variation 8 may include the product as set forth in any of variations 1 through 7 wherein the lever assembly may include a lever, a second roller, a roller shaft, and at least one lever knob.

Variation 9 may include the product as set forth in any of variations 1 through 8 wherein the handle assembly may include a handle arm and a tapered handle and wherein the handle assembly may be in mechanical communication with the roller assembly.

Variation 10 may include the product as set forth in any of variations 1 through 9 and further may include at least one cord bumper.

Variation 11 may include the product as set forth in any of variations 1 through 10 and further may include a removable net.

Variation 12 may include the product as set forth in any of variations 1 through 11 wherein the removable net may include a third opening, the third opening in communication with the second opening of the housing.

Variation 13 may include the product as set forth in any of variations 1 through 12 and may further include a hinge bracket and a hinge pin, and wherein the housing further may include a neck defining a pin slot.

Variation 14 may include a product that may include a housing that may include a first segment and a second segment and defining a first opening and a second opening; wherein the first segment defines a first through hole, first guide channel, a first lever slot, and a first lever lock notch, and wherein the second segment defines a second through hole, a second guide channel, a second lever slot, and a second lever lock notch. The product may further include a roller assembly positioned between the first segment and the second segment and in mechanical communication with the first through hole and the second through hole. The product may further include a lever assembly positioned between the first segment and the second segment and in mechanical communication with the first and second guide channels, the first and second lever slots, and the first and second lever lock notches. The product may further include a handle assembly in mechanical communication with the roller assembly.

Variation 15 may include a product as set forth in variation 14 wherein the roller assembly may be a press-fit assembly and may include a first roller may include an elastic roller surface, a first hub, a second hub, a first clip bearing, and a second clip bearing.

Variation 16 may include a product as set forth in any of variations 14 through 15 wherein the first segment further may include a first cord bumper and the second segment further may include a second cord bumper.

Variation 17 may include a product as set forth in any of variations 14 through 16 and further may include a removable net that may include a third opening, the third opening in communication with the second opening of the housing.

Variation 18 may include a product as set forth in any of variations 14 through 17 wherein the first segment and second segment may be detachably combinable to complete the housing.

Variation 19 may include a product as set forth in any of variations 14 through 18 wherein the lever assembly may be constructed and arranged to bias a cord towards the first roller and the roller assembly may be constructed and arranged to allow a user to rotate at least the first roller.

According to variation 20, a product may include a housing that may include a first segment and a second segment and defining a first opening and a second opening; wherein the first segment defines a first through hole, first guide channel, a first lever slot, and a first lever lock notch, and wherein the second segment defines a second through hole, a second guide channel, a second lever slot, and a second lever lock notch. The product may further include a roller assembly that may include a first roller may include an elastic roller surface, the roller assembly being positioned between the first segment and the second segment and in mechanical communication with the first through hole and the second through hole. The product may further include a lever assembly positioned between the first segment and the second segment and in mechanical communication with the first and second guide channels, the first and second lever slots, and the first and second lever lock notches, the lever assembly being constructed and arranged to bias a cord towards the first roller. The product may further include a handle assembly in mechanical communication with the roller assembly constructed and arranged to allow a user to rotate at least the first roller.

The above description of select variations within the scope of the invention is merely illustrative in nature and, thus, variations or variants thereof are not to be regarded as a departure from the spirit and scope of the invention.

What is claimed is:

1. A product comprising:

a housing comprising a first segment and a second segment and defining a first opening and a second opening;

a roller assembly and a lever assembly received in the housing; the roller assembly comprising a first roller comprising an elastic material; and a handle assembly connected to the roller assembly.

2. The product as set forth in claim 1, wherein the first segment and second segment are detachably combinable to complete the housing.

3. The product as set forth in claim 1, wherein the second segment defines a second guide channel, a second lever slot, and a second lever lock notch.

4. The product as set forth in claim 1, wherein the lever assembly comprises a lever, a second roller, a roller shaft, and at least one lever knob.

5. The product as set forth in claim 1, wherein the handle assembly comprises a handle arm and a tapered handle and wherein the handle assembly is in mechanical communication with the roller assembly.

6. The product as set forth in claim 1, further comprising at least one cord bumper.

7. The product as set forth in claim 1, further comprising a removable net.

8. The product as set forth in claim 7, wherein the removable net comprises a third opening in communication with the second opening of the housing.

9. The product as set forth in claim 1, further comprising:

a hinge bracket and a hinge pin, and wherein the housing further comprises a neck defining a pin slot.

10. A product comprising:

a housing comprising a first segment and a second segment and defining a first opening and a second opening;

a roller assembly and a lever assembly received in the housing;

a handle assembly connected to the roller assembly, wherein the first segment defines a first guide channel, a first lever slot, and a first lever lock notch.

11. A product comprising:

a housing comprising a first segment and a second segment and defining a first opening and a second opening;

a roller assembly and a lever assembly received in the housing;

a handle assembly connected to the roller assembly, wherein the roller assembly comprises a first roller, at least one hub, and at least one clip bearing.

12. A product comprising:

a housing comprising a first segment and a second segment and defining a first opening and a second opening;

a roller assembly and a lever assembly received in the housing;

a handle assembly connected to the roller assembly, wherein the roller assembly is a press-fit assembly comprising a first roller, a first hub, a second hub, a first clip bearing, and a second clip bearing.

13. A product comprising:

a housing comprising a first segment and a second segment and defining a first opening and a second opening; wherein the first segment defines a first through hole, first guide channel, a first lever slot, and a first lever lock notch, and wherein the second segment defines a second through hole, a second guide channel, a second lever slot, and a second lever lock notch;

a roller assembly disposed between the first segment and the second segment and in mechanical communication with the first through hole and the second through hole;

a lever assembly disposed between the first segment and the second segment and in mechanical communication with the first and second guide channels, the first and second lever slots, and the first and second lever lock notches; and a handle assembly in mechanical communication with the roller assembly.

14. The product as set forth in claim 13, wherein the roller assembly is a press-fit assembly comprising a first roller comprising an elastic roller surface, a first hub, a second hub, a first clip bearing, and a second clip bearing.

15. The product as set forth in claim 13, wherein the first segment further comprises a first cord bumper and the second segment further comprises a second cord bumper.

16. The product as set forth in claim 13, further comprising:

a removable net comprising a third opening, the third opening in communication with the second opening of the housing.

17. The product as set forth in claim 13 wherein the first segment and second segment are detachably combinable to complete the housing.

18. The product as set forth in claim 13 wherein the lever assembly is constructed and arranged to bias a cord towards the first roller and the roller assembly is constructed and arranged to allow a user to rotate at least the first roller.

19. A product comprising:

a housing comprising a first segment and a second segment and defining a first opening and a second opening; wherein the first segment defines a first through hole, first guide channel, a first lever slot, and a first lever lock notch, and wherein the second segment defines a second through hole, a second guide channel, a second lever slot, and a second lever lock notch;

a roller assembly comprising a first roller comprising an elastic roller surface, the roller assembly being disposed between the first segment and the second segment and in mechanical communication with the first through hole and the second through hole;

a lever assembly disposed between the first segment and the second segment and in mechanical communication with the first and second guide channels, the first and second lever slots, and the first and second lever lock notches, the lever assembly being constructed and arranged to bias a cord towards the first roller; and a handle assembly in mechanical communication with the roller assembly constructed and arranged to allow a user to rotate at least the first roller.

* * * * *